United States Patent [19]

Courson et al.

[11] 4,028,902

[45] June 14, 1977

[54] APPARATUS FOR LAYING ELONGATED FLEXIBLE TUBING

[75] Inventors: Thomas G. Courson, Mansfield; William L. Schlueter, Rantoul; Thomas T. Kelly, Champaign, all of Ill.

[73] Assignee: Central Illinois Tile co., Champaign, Ill.

[22] Filed: Oct. 1, 1976

[21] Appl. No.: 728,556

[52] U.S. Cl. ..... 61/72.6; 61/72.4

[51] Int. Cl.[2] ..... E02F 5/10; E02B 11/00

[58] Field of Search ..... 61/72.6, 72.4; 404/100, 404/102, 113, 114; 37/142.5, 193, DIG. 18; 172/40

[56] References Cited

UNITED STATES PATENTS

| | | | |
|---|---|---|---|
| 286,861 | 10/1883 | Speed | 61/72.6 X |
| 2,044,883 | 6/1936 | Jackson | 404/102 |
| 3,011,278 | 12/1961 | Lust | 37/142.5 X |
| 3,201,948 | 8/1965 | Schramm | 61/72.6 |
| 3,429,130 | 2/1969 | Feiner et al. | 404/113 X |
| 3,603,097 | 9/1971 | Zakiewicz | 61/72.6 X |

FOREIGN PATENTS OR APPLICATIONS

| | | | |
|---|---|---|---|
| 410,900 | 5/1934 | United Kingdom | 61/72.6 |

*Primary Examiner*—Dennis L. Taylor
*Attorney, Agent, or Firm*—Wegner, Stellman, McCord, Wiles & Wood

[57] ABSTRACT

An apparatus for laying elongated, flexible tubing in a trench and adapted to be secured to a trenching boom carried by a vehicle. The apparatus includes an upwardly open hopper having a forward end adapted to be secured to the trenching boom in trailing relation thereto, and a trailing end. A first partition is adjacent the forward end and defines a flexible tubing tunnel, the tunnel opening to the top and bottom of the hopper so that flexible tubing may enter the top of the hopper and exit the bottom thereof behind the trenching boom. A second partition is located in the hopper rearwardly of the first partition and defines first and second fill receiving compartments. The compartments open upwardly to receive fill material such as sand, and downwardly to release fill material rearwardly of the tunnel. The second compartment opens downwardly at a level above the downward opening of the first compartment and a first compactor is carried by the hopper rearwardly of the first compartment and forwardly of the second compartment for compacting fill released from the first compartment. A second compactor is carried by the hopper rearwardly of the second compartment for compacting fill material released from the second compartment. A groover is located on the bottom of the hopper forwardly of the tunnel for cutting a groove in the bottom of the trench dug by the trenching boom. The groove is configured to cut a groove having a cross section substantially equal to that of the lower one-third of the flexible tubing being laid.

7 Claims, 4 Drawing Figures

APPARATUS FOR LAYING ELONGATED FLEXIBLE TUBING

BACKGROUND OF THE INVENTION

This invention relates to apparatus for laying flexible tubing and is particularly suited for laying such tubing in conjunction with road construction or maintenance operations.

Most modern highways have traffic carrying lanes formed of concrete or the like and an adjacent asphalt shoulder. Experience has shown that frequently water will penetrate the interface of the concrete and the asphalt and enter the subbase upon which the concrete and the asphalt are carried. After prolonged periods of time, the subbase will be eroded in such areas, undermining support for the concrete and/or asphalt. This, in turn, results in cracking or even collapse of the road components.

It has been determined that such erosion, and the deleterious effects caused thereby, can be greatly minimized by providing means for draining water flowing through the concrete-asphalt interface by laying drain tile below the concrete-asphalt interface, which drain tile extends longitudinally of the roadway. At the points along the length of the drain tile, drain spurs extend transversely of the roadway to an adjacent ditch of the like. However, the use of such drain tile has been at a relatively low level due to the considerable expense of installation and the rather strong possibility of improper installation if flexible drain tile is utilized.

For example, when flexible tile is used, care must be taken so as not to partially or wholly collapse the tile when fill is placed over the tile which would obstruct the flow of the water to be drained through the tile. Moreover, adequate compaction of the fill at the time it is placed over the tile has been difficult to achieve, with the result that at some later date, it will compact further over a period of time which will result in settling of the overlying pavement.

Moreover, the operations heretofore required to adequately and properly install tile in such instances have been very time-consuming, requiring a considerable number of different pieces of equipment as well as several operators to run each piece of equipment.

SUMMARY OF THE INVENTION

It is the principal object of the invention to provide a new and improved apparatus for laying flexible tubing, such as drain tile. More specifically, it is an object of the invention to provide such an apparatus wherein the operations of laying the flexible tubing, introducing the fill, and compacting the fill are all performed by a single apparatus operated in connection with a trenching device which digs the trench to receive the drain tile.

An exemplary embodiment of the invention achieves the foregoing object in a structure including an apparatus that is adapted to be attached to a vehicle as, for example, the trenching boom carried by a vehicle. The apparatus includes a housing having a top, a bottom, a front and a rear. A downwardly extending tunnel is located in the housing adjacent the front thereof and has openings at the top and bottom of the housing through which the flexible drain tile may enter and exit the housing. Means are provided in the housing to define a fill receiving space and include an upper opening into which fill may be introduced into the fill receiving space. The housing is provided with a first fill depositing opening in its bottom rearwardly of and above the bottom opening of the tile tunnel and is in communication with the fill receiving space. A compacting device is carried by the housing and is located rearwardly of the first fill depositing opening for compacting fill exiting the first fill depositing opening. A second fill depositing opening is located in the bottom, rearwardly and above the first fill depositing opening and in communication with the fill receiving space. A second compactor is carried by the housing rearwardly of the second fill depositing opening for compacting fill exiting the housing through the second fill depositing opening.

As a consequence of the structure, when attached to a trenching boom on a vehicle, the cutting of the trench to receive the tile, the laying of the tile, and the introduction of fill in two separate steps wherein, for each step, the fill is separately compacted, are all performed in a single apparatus.

In a highly preferred embodiment, a generally semicylindrical groover is secured to the bottom of the housing to extend downwardly therefrom forwardly of the bottom opening of the tunnel. The groover has a cross section substantially identical to that of the lower third of the tubing being laid so that the tubing is deposited in the groove and is supported by the sides of the groove against collapse when fill is subsequently deposited thereover.

In one embodiment of the invention, the fill receiving space is divided by a partition into first and second fill receiving compartments, one for each of the openings, so as to allow the use of different types of fill in a single operation.

Other objects and advantages will become apparent from the following specification specification taken in connection with the accompanying drawings.

DESCRIPTION OF THE PREFERRED EMBODIMENT

Figures 1, 2, 3, 4:
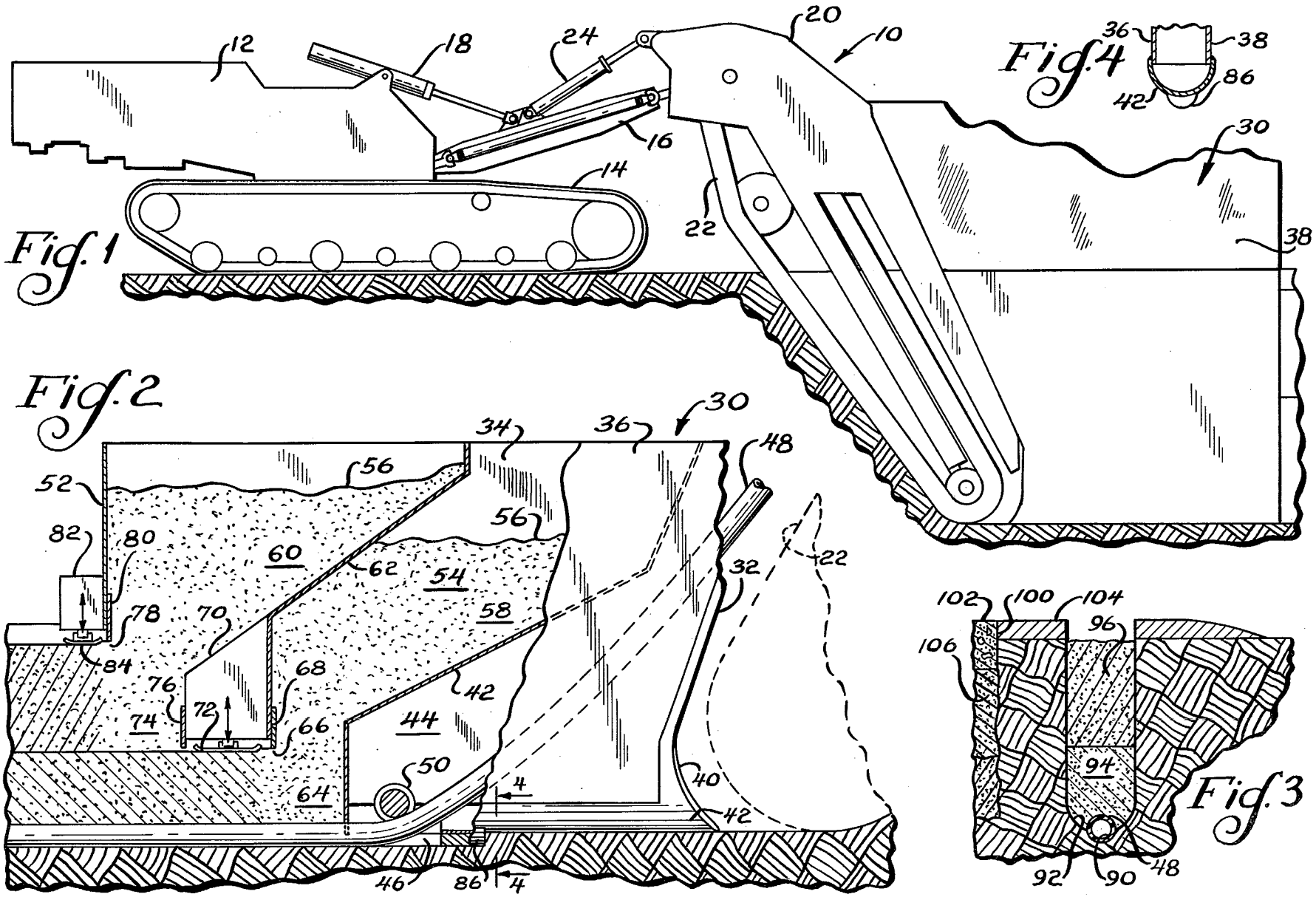
FIG. 1 is a side elevation of an apparatus made according to the invention and mounted on the trenching boom of a trenching vehicle.
FIG. 2 is an enlarged, vertical section of the apparatus taken oppositely of the showing of FIG. 1.
FIG. 3 is a vertical section of a roadway illustrating the condition thereof after the laying of a flexible drain tile through use of the apparatus of the invention.
FIG. 4 is a fragmentary sectional view taken approximately along the line 4—4 of FIG. 2.

An exemplary embodiment of a flexible tile laying apparatus made according to the invention is illustrated in FIG. 1 in connection with a trenching apparatus, generally designated 10. The trenching apparatus 10 includes a vehicle 12 provided with tracks 14 by which it may traverse the ground. Extending upwardly and rearwardly from the vehicle 12 is a boom 16, the attitude of which may be controlled through selective operation of a cylinder 18. The rearward end of the boom 16 mounts a trenching boom 20 including a trenching chain 22 which is driven in a conventional fashion to cut a trench in the terrain underlying the vehicle 12. The attitude of the trenching boom 20 can be controlled through appropriate operation of a cylinder 24.

While not shown, the apparatus 10 will typically include a sophisticated control circuit by which the cylinders 18 and 24 are controlled to control the grade of the bottom of the trench being dug. For example, if the apparatus is of the type commercially available from Hoes of America, Inc. of Arthur, Ill., the same will include a laser control system.

The drain tile laying apparatus made according to the invention is secured by any suitable means to the rearward end of the trenching boom 20 so as to be carried therewith as the latter is moved by the vehicle and to move vertically therewith as the control system adjusts the position of the trenching boom 20 to obtain the desired grade characteristics.

The apparatus includes a housing, generally designated 30. As best seen in FIG. 2, the housing 30 has a forward end 32 which is located immediately rearwardly of the trenching chain 22 shown in dotted lines in FIG. 2. The housing 30 also includes opposed sides 34 and 36, the upper ends of which may flare outwardly as at 38 (FIG. 1) to define a hopper to be described in greater detail hereinafter. The forward end 32 of the housing 30 includes a concave surface 40 adjacent the lower end and the bottom 42 of the housing 30 is semi-cylindrical, as best seen in FIG. 4.

Extending between the side walls 34 and 36 adjacent the front end 32 is a first partition 42 which, together with the front end 32, define a flexible tile receiving tunnel 44. The tunnel 44 is open at its upper end (not shown) as well as at its lower end at 46 and is adapted to receive perforated, flexible drain tubing 48 through its upper end and lay the same in the bottom of the trench being dug by the chain 22 through the lower end 46. Preferably, a guide roller 50 is suitably journalled between the walls 34 and 36 adjacent the opening 46 to assist in redirecting the tubing 48 into a substantially horizontal attitude without causing the same to kink.

The housing 30 also includes a rear wall 52 extending between the side walls 34 and 36 and the area between the rear wall 52 and the first partition 42 defines a fill receiving space 54. The upper end of the housing 30 is open so that fill, such as sand 56, may be introduced into the fill receiving space 54. In general, the fill receiving space 54 will be divided into a first fill receiving compartment 58 and a second fill receiving compartment 60 by a second partition 62 extending between the side walls 34 and 36. Of course, both the compartments 58 and 60 will be upwardly open so that fill can be disposed therein. In this connection, the purpose of employing flared upper sides as mentioned previously is to increase the capacity of the compartments 58 and 60.

The bottom of the housing 30 includes a first fill depositing opening 64 which is in communication with the first fill receiving compartment 58 and, as seen in FIG. 2, allows fill therein to be deposited upon the flexible tile 48 immediately after it has been laid. The opening 64 immediately follows the opening 46 and the trailing edge thereof is disposed above the opening 46, as illustrated at 66, so as to allow a predetermined level of fill to be deposited upon the tubing 48. Preferably, the edge 66 of the opening is defined by a plate 68 which is adjustably mounted on the forward side of the partition 62. By adjusting the vertical position of the plate 68, the precise level of the fill deposited from the compartment 58 can be suitably controlled.

Immediately rearwardly of the opening 64, the partition 62 carries a housing 70 contained within the housing 30. Within the housing 70 is an electrically or hydraulically operated compacting device having a lower vertically oscillating tamping shoe 72. The tamping shoe 72 compacts the fill emanating from the compartment 58 through the opening 64. If the compactor within the housing 70 is electrically operated, provision can be made elsewhere in the housing 30, or even within the housing 70, for an electrical generator. If the compactor is driven hydraulically, hydraulic conduits (not shown) may be linked up with a hydraulic pump carried by the vehicle 12.

The housing 30, at its bottom, is also provided with a second fill depositing opening 74, through which fill from the compartment 60 may be deposited on top of the fill emanating from the compartment 58 and compacted by the tamping shoe 72. To prevent such fill from moving forwardly to obstruct operation of the tamping shoe 72, a downwardly extending plate 76 is provided on the rear of the housing 70. If desired, the plate 76 may be made adjustable.

The second fill receiving opening 74 has a rear edge 78 that is above the opening 64. The edge 78 may be defined by a vertically adjustable plate 80 mounted on the rear wall 52. The rear wall 52, on its rear surface, carries a housing 82 for a compactor having a vertically oscillating tamping shoe 84 which compacts the fill emanating through the opening 74 from the compartment 60. The compactor driving the shoe 84 again can be either hydraulically or electrically driven.

The assemblage is generally completed by the provision of a groover 86 mounted on the bottom 42 of the housing 30 just forwardly of the opening 30. As best seen in FIG. 4, the groover 86 is semi-cylindrical, while as seen in FIG. 2, the front end of the groover 86 is defined by a plane extending transversely to the cylindrical axis of the groover 86. The groover 86 is located so as to be below the level of the bottom of the trench cut by the chain 22. By reason of the weight of the housing 30, particularly when the compartments 58 and 60 contain fill, such as sand, and the downward forces applied to the assemblage through one or the other, or both, of the cylinders 18 and 24, the groover 86 will cut a semi-cylindrical groove in the bottom of the trench already formed by the trenching chain 22 on the boom 20.

The groover 36 has a cross section that is identical to the cross section of the lower half of the flexible drain tile 48 being laid. In the specific instance illustrated, the tile 48 is cylindrical, hence the semi-cylindrical cross section of the groover 86. Of course, if the tile 48 were to have something other than a cylindrical cross section, the shape of the groover 86 would be changed commensurately.

In any event, the tile 48 is laid in the groove 90 (FIG. 3) cut by the groover 86 in the bottom of the trench 92 and, as can be seen from FIG. 3, will be firmly supported about its lower half by the sides of the groove 90 to prevent collapse. In general, it is desired that the support be about the lower half of the tile 48, but in some instances, the support may be as little as about the lower one-third, in which case, the cross section 86 of the groover may be modified accordingly.

FIG. 3 also illustrates the condition of the trench after one pass of the apparatus has been made. The fill 94 represents fill that has been deposited from the opening 64 and compacted by the tamping shoe 72, while the fill 96 represents fill emanating from the compartment 60 and compacted by the tamping shoe 84. Because of the two-stage compacting operation, 90% or greater compaction of the fill can be obtained so that settling after a prolonged period will be minimal.

FIG. 3 also illustrates the advantages of the apparatus in connection with the laying of flexible tile in already constructed roadways. In particular, the apparatus 10 can be driven so as to cut the trench 92 just a few inches from the edge 100 of concrete paving 102 and through the adjacent asphalt shoulder 104. As a result, the tile 48 will be in proximity to the subbase 106 and will receive water draining through the interface between the shoulder 104 and the lane pavement 102 to prevent erosion. The trench will, of course, be filled to approximately the level illustrated in FIG. 3 following one pass of the apparatus with the fill being highly compacted. Thereafter, the cut in the asphalt shoulder 104 may be filled with asphalt in the typical manner without fear of extensive settling since the fill in the trench has already been compacted.

At the same time, the use of the groove for receipt of the tile 48 to support the same prevents partial or entire collapse of the tile 48 during the compacting operation so that obstruction of water flow through the tile 48 will not occur.

It will therefore be appreciated by those skilled in the art that use of the invention minimizes the need for multiple pieces of equipment in that the apparatus is easily adaptable to a conventional trenching apparatus. At the same time, labor requirements are minimized since all that is necessary is one operator for the trencher apparatus 10. The apparatus accomplishes all operations required in the laying of drain tile in the case of new road construction and in the case of road maintenance through the addition of drain tile, accomplishes all necessary operations save for the patching of the asphalt shoulder 104.

We claim:

1. Apparatus for laying elongated flexible tubing in a trench adapted to be secured to a trenching boom carried by a vehicle, said apparatus comprising:

an upwardly open hopper having a forward end adapted to be secured to a trenching boom in trailing relation thereto, and a trailing end;

a first partition adjacent said forward end defining a flexible tubing tunnel, said tunnel opening to the top and bottom of said hopper so that flexible tubing may enter the top of said hopper and exit the bottom thereof behind said trenching boom;

a second partition in said hopper rearwardly of said first partition defining first and second fill material receiving compartments, said compartments opening upwardly to receive fill material such as sand and downwardly to release fill material rearwardly of said tunnel, said second compartment opening downwardly at a level above the downward opening of said first compartment;

a first compactor carried by said hopper rearwardly of said first compartment and forwardly of said second compartment for compacting fill material released from said first compartment;

a second compactor carried by said hopper rearwardly of said second compartment for compacting fill material released from said second compartment; and a groover carried by said hopper at the bottom thereof forwardly of said tunnel for cutting a groove in the bottom of the trench dug by the trenching boom to which said apparatus may be attached, said groover being configured to cut a groove having a cross section substantially equal to that of the lower third of the flexible tubing being laid.

2. Flexible tube laying apparatus for attachment to a vehicle, comprising:

a housing having a top, a bottom, a front and a rear;

a downwardly and rearwardly extending tunnel in said housing adjacent the front thereof, said tunnel having openings at the top and the bottom of said housing and being adapted to receive a flexible tube to be laid;

guide means in said tunnel adjacent said bottom opening for guiding a flexible tube out of said bottom opening;

a first fill receiving compartment in said housing having an upper opening into which fill may be deposited and a lower opening from which fill may exit said first compartment, said first compartment lower opening being aligned with said bottom opening from front to rear of said housing and being above said bottom opening whereby fill from said first compartment will be deposited upon a flexible tube exiting said tunnel through said bottom opening;

a compactor within said housing and just rearwardly of said first compartment lower opening for compacting fill deposited from said first compartment; and a second fill receiving compartment in said housing having an upper opening into which fill may be deposited and a lower opening from which fill may exit and said second compartment, said second compartment lower opening being aligned with said bottom opening and said first compartment lower opening from front to rear of said housing and being above said first compartment opening whereby fill from said second compartment will be deposited on compacted fill from said first compartment.

3. Flexible tube laying apparatus according to claim 2 further including an additional compactor carried by said housing and just rearwardly of said second compartment lower opening for compacting fill deposited from said second compartment.

4. Flexible tube laying apparatus according to claim 2 wherein said front includes a concave formation adjacent said bottom and forwardly of said bottom opening, said concave formation adapted to be complementary to the configuration of the lower end of a trenching device, and a groover carried by said bottom forwardly of said bottom opening, said groover having a cross section transverse to the front to rear of said housing substantially conforming to that of at least the lower third of the flexible tubing to be passed through said tunnel.

5. Flexible tube laying apparatus for attachment to a vehicle comprising a housing having a top, a bottom, a front and a rear; a downwardly extending tunnel in said housing adjacent the front thereof, said tunnel having openings at the top and bottom of said housing and adapted to receive a flexible tube to be laid; means in said housing defining a fill receiving space and including an upper opening into which fill may be introduced into said fill receiving space; a first fill depositing opening in said bottom rearwardly and above said bottom opening, said first fill receiving opening being in communication with said fill receiving space; compacting means within said housing and rearwardly of said first fill depositing opening for compacting fill exiting through said first fill depositing opening; a second fill depositing opening in said bottom rearwardly and above said first fill depositing opening and in communication with said fill receiving space; and second compacting means carried by said housing rearwardly of said second fill depositing opening for compacting fill exiting said housing through said second fill depositing opening.

6. The apparatus of claim 5 further including a partition in said fill receiving space to define two fill receiving compartments, one for each of said fill depositing openings.

7. The apparatus of claim 5 further including a generally semicylindrical groover secured to said bottom to extend downwardly therefrom forwardly of said bottom opening and extending in a direction front to rear of said housing.

* * * * *